US012781468B2

(12) United States Patent
Mang et al.

(10) Patent No.: US 12,781,468 B2
(45) Date of Patent: Nov. 3, 2026

(54) DEVICE FOR MONITORING AND ASSISTING AN OPERATOR OF A CONSTRUCTION MACHINE

(71) Applicant: Liebherr-Hydraulikbagger GmbH, Kirchdorf/Iller (DE)

(72) Inventors: Florian Mang, Memmingen (DE); Dieter Ansorge, Rot an der Rot (DE)

(73) Assignee: LIEBHERR-HYDRAULIKBAGGER GMBH, Kirchdorf/Iller (DE)

( * ) Notice: Subject to any disclaimer, the term of this patent is extended or adjusted under 35 U.S.C. 154(b) by 24 days.

(21) Appl. No.: 19/097,247

(22) Filed: Apr. 1, 2025

(65) Prior Publication Data

US 2025/0327274 A1 Oct. 23, 2025

(30) Foreign Application Priority Data

Apr. 17, 2024 (DE) ..... 10 2024 110 737.5

(51) Int. Cl.
*E02F 9/20* (2006.01)
*E02F 9/24* (2006.01)

(52) U.S. Cl.
CPC ..... *E02F 9/2033* (2013.01); *E02F 9/2004* (2013.01); *E02F 9/24* (2013.01)

(58) Field of Classification Search
CPC ..... E02F 9/2033; E02F 9/2004; E02F 9/24; E02F 9/265
See application file for complete search history.

(56) References Cited

U.S. PATENT DOCUMENTS

| | | | | |
|---|---|---|---|---|
| 12,180,050 | B2 | 12/2024 | Cadou et al. | |
| 2017/0107690 | A1* | 4/2017 | Yamashita | B66C 23/84 |
| 2022/0227610 | A1* | 7/2022 | Cadou | B66F 9/065 |
| 2022/0316179 | A1* | 10/2022 | Katoh | E02F 9/0833 |
| 2024/0026647 | A1 | 1/2024 | Ikeda et al. | |
| 2024/0083729 | A1 | 3/2024 | Messina et al. | |
| 2026/0015824 | A1* | 1/2026 | Cesur | E02F 9/123 |

FOREIGN PATENT DOCUMENTS

| | | | |
|---|---|---|---|
| DE | 602004010192 | T2 | 2/2008 |
| DE | 112019001248 | T5 | 12/2020 |
| DE | 102021126098 | A1 | 4/2022 |
| DE | 102022118595 | A1 | 2/2023 |
| DE | 102022126034 | A1 | 12/2023 |
| EP | 3980365 | B1 | 11/2023 |

* cited by examiner

*Primary Examiner* — Tarek Elarabi
(74) *Attorney, Agent, or Firm* — McCoy Russell LLP

(57) ABSTRACT

The disclosure relates to a device for monitoring and assisting an operator of a construction machine, which comprises a seat contact switch for detecting whether an operator is sitting in a seat of the construction machine, a door close switch for detecting whether a door of a driver's cab of the construction machine is closed, a grip sensor for detecting whether an operating lever arranged to the left of the seat and/or an operating lever arranged to the right of the seat for controlling a servo circuit of the construction machine is actuated by an operator, and an evaluation unit designed to limit or stop a capacity of the construction machine depending on the detected states of the seat contact switch, the door close switch and the grip sensor.

17 Claims, 9 Drawing Sheets

DEVICE FOR MONITORING AND ASSISTING AN OPERATOR OF A CONSTRUCTION MACHINE

CROSS REFERENCE TO RELATED APPLICATION

The present application claims priority to German Patent Application No. 10 2024 110 737.5 filed on Apr. 17, 2024. The entire contents of the above-listed application are hereby incorporated by reference for all purposes.

TECHNICAL FIELD

The present disclosure relates to a device for monitoring and assisting an operator of a construction, in particular an excavator.

BACKGROUND

Safety plays a crucial role in the world of construction machinery. Given the potential risks associated with operating heavy machinery, it is essential to implement effective safety mechanisms to protect both operators and their environment.

SUMMARY

A typical safety mechanism is a safety lever, which is located on the seat of an excavator and acts as a barrier to an operator leaving or entering. In a first (horizontal) position, the safety lever blocks the path for the seated operator to the driver's door, so that the operator must first move the safety lever to a second (vertical) position. Only then is it possible for the operator to leave the construction machine through the driver's door without coming into contact with the safety lever. In this second (vertical) position, the safety lever ensures that the excavator control is deactivated, whereas the excavator control is activated when the safety lever is in its second (horizontal) position.

This safety feature contributes significantly to the safety of the operator and surrounding persons and is particularly important to prevent unintentional movements of the excavator if the operator leaves the seat.

This is particularly relevant when changing operators or getting on and off the machine, as the folding safety lever ensures that the machine remains in a safe state until a new operator is ready to take control of the construction machine.

The safety lever can be coupled to a switch, which is typically designed as a positive-opening contact and immediately deactivates a servo control of the construction machine so that there is no danger from the construction machine while there is no operator in the driver's cab.

Nevertheless, it is still desirable to further reduce the risk of accidents caused by construction machinery and to improve safety for the driver and those around the construction machine.

This is achieved with a device for monitoring and assisting an operator of a construction machine as described herein.

The device according to the disclosure can detect safety-critical operator behaviour and restrict the functions of the construction machine controlled by the operator. This ensures that the legal requirements regarding the correct behaviour of a construction machine operator are implemented and that an efficient working speed is achieved at the same time. In addition, expected risk-relevant special operating states can be recognised, such as an operator working in a standing position, as is often the case with excavator work for sewer laying, and the functionality of the construction machine can be restricted in response. In addition, the operator can also be made aware of any incorrect behaviour and shown measures to remedy the situation. The safety lever normally required by law can also be dispensed with in a construction machine containing the device according to the disclosure.

According to the disclosure, it is provided that the device for monitoring and assisting an operator of a construction machine, which comprises a seat contact switch for detecting whether an operator is sitting in a seat of the construction machine, a door close switch for detecting whether a door of a driver's cab of the construction machine is closed, a grip sensor for detecting whether an operating lever arranged to the left of the seat and/or an operating lever arranged to the right of the seat for controlling a servo circuit, i.e. the hydraulic system, of the construction machine is actuated by an operator, and an evaluation unit designed to limit or stop a capacity of the construction machine depending on the detected states of the seat contact switch, the door close switch and the grip sensor and/or to provide a signal to signal a critical state.

The basic concept of the disclosure is to implement different sensors in the area of the driver's cab of the construction machine and to interconnect them logically in order to find out whether the construction machine poses an increased hazard potential or not. If such an increased hazard potential is detected, appropriate countermeasures aimed at restricting the functionalities of the construction machine are taken.

In the sense of a non-restrictive assistance system design, it is also possible to provide a signal to indicate a critical state if an increased hazard potential is detected.

This signal can be a visual signal that alerts the operator of the construction machine to the increased hazard potential. For example, a signal light can be activated if the evaluation unit recognises an increased hazard potential. According to an optional further development of the present disclosure, it may be provided that a signal light is arranged in the area of an operating lever, for example in the lower third of the operating lever, so that the operator of the construction machine can be signalled in a simple manner that they are currently in a state in which an increased hazard potential has been detected.

It may also be provided that a signal light changes colour depending on the hazard potential, so that a particularly dangerous state is signalled to the operator with a red colour, for example, and a moderately dangerous state is signalled with a yellow colour, for example.

This visual warning makes the operator of the construction machine aware that there is an increased risk potential.

It may be provided that the capacity of the construction machine comprises a driving speed of the construction machine, an upper carriage speed of the construction machine and/or operating the servo circuit of the construction machine. The servo circuit of the construction machine can represent the hydraulic system of the working machine, which is used, among other things, to actuate the primary functionality of the construction machine.

The servo circuit on a hydraulic excavator is a central component of the hydraulic control system, specifically designed to control the movements and operations of the excavator in a precise and efficient manner. A key feature of the servo circuit is its ability to provide precise control of the hydraulic functions of the excavator. This allows the operator to move the upper carriage and/or the working tools of the excavator, such as the arm, bucket or shovel, with a high degree of precision.

The servo circuit is characterised by its responsiveness to the operator's inputs. Movements of an operating lever are directly translated into hydraulic actions (moving the upper carriage or implement) of the excavator, wherein the circuit responds to even the slightest movements and adjustments of the operator to enable precise operations.

According to an optional further development of the present disclosure, it can be provided that the evaluation unit is designed to limit or stop a capacity of the construction machine or to give a signal to limit or stop a capacity of the construction machine if the seat contact switch detects that the operator is not sitting in the seat of the construction machine, if the door close switch detects that the door of the driver's cab is open, and if the grip sensor detects that one or both of the operating levers are actuated, optionally wherein the evaluation unit is designed to limit a maximum upper carriage speed of the construction machine.

If the evaluation unit detects that the operator is not sitting in their seat but is operating at least one control lever with the driver's door open, this is a strong indication that the construction machine is either being controlled by a person outside the driver's cab or that the operator is standing in the driver's cab. This state can be classified as a foreseeable operating error of a construction machine, as it is often difficult for an operator sitting in a seat to see a shaft located directly in front of an excavator during excavator work to lay sewers, for example. A standing position is therefore assumed in the driver's cab.

The grip sensor can be designed in such a way that even touching it with the operator's hand indicates that the corresponding operating lever has been actuated. It does not necessarily have to involve moving or pressing a lever or button on the operating lever. Simply reaching round or touching the operating lever may be sufficient.

If the evaluation unit now comes to the conclusion that such a case exists, it can react by restricting a capacity of the construction machine. For example, the turning speed of the upper carriage can be reduced to prevent the likelihood of an accident. In addition, the overall speed of the servo control could also be reduced compared to its normal speed to take into account the situation where the construction machine is operated by an operator who is not in the driver's seat.

According to a further embodiment of the present disclosure, it can be provided that the evaluation unit is designed to stop the servo circuit of the construction machine if the seat contact switch detects that the operator is sitting in the seat of the construction machine and if the grip sensor detects that neither of the operating levers for actuating the servo circuit of the construction machine are actuated, optionally wherein the evaluation unit is designed to stop the servo circuit of the construction machine only after a certain period of time has elapsed in the state leading to the stop, e.g. more than 3 seconds.

If the evaluation unit recognises that the operator of the construction machine is sitting on the seat and is not actuating either of the two control levers to operate the servo circuit, the evaluation unit can generate a signal aimed at stopping the servo circuit. This saves energy, as the servo circuit does not have to be kept running even though the operator is in the cab. Using the example of an excavator, this can occur if the excavator is moved on the construction site without the servo circuit, which can be actuated via the two operating levers, being used.

It can also be provided according to the present disclosure that the device comprises a driving function switch, for example an accelerator pedal switch, for detecting whether a driving function or an accelerator pedal of the construction machine is actuated, wherein the evaluation unit is designed to limit or stop a capacity of the construction machine also depending on the detected state of the driving function switch.

A driving function switch, for example an accelerator pedal switch, is now provided as a further sensor that the evaluation unit takes into consideration for detecting the different states. A driving function switch can be realised not only by an accelerator pedal switch but also, for example, by a joystick or similar, which represents an operating element for controlling the driving functionality of the construction machine. The actuation of the drive function switch can therefore also be checked by the evaluation unit and, in conjunction with the other sensors, lead to the detection of a specific state of the construction machine, in which the evaluation unit limits a capacity of the construction machine or outputs a signal to limit a capability of the construction machine.

The evaluation unit can be designed to limit the maximum driving speed of the construction machine if the seat contact switch detects that the operator is not sitting in the seat of the construction machine, and if the driving function switch detects that the acceleration pedal or another operating element for controlling the driving function of the vehicle is actuated, optionally wherein the evaluation unit is designed to initially limit the maximum driving speed of the construction machine for a certain period of time and then set it to zero.

This prevents the unauthorised state whereby a construction machine is to be moved while the driver is standing. The maximum driving speed of the construction machine can first be reduced in such a detected state before the driving speed is set to zero.

Alternatively and/or additionally, the evaluation unit can be designed to limit or stop a capacity of the construction machine if the seat contact switch detects that the operator is not sitting in the seat of the construction machine, if the grip sensor detects that only the left of the two operating levers is actuated, and if the driving function switch detects that the acceleration pedal or another operating element for controlling the driving functionality are not actuated, optionally wherein the evaluation unit is designed to limit or stop the servo circuit in such a case.

Such a state may indicate that an operator has unintentionally actuated the left control lever, i.e. the control lever facing the driver's door, when exiting the driver's cab. Due to the narrow driver's cab, for example, this can occur due to a supporting movement when leaving the cab, so that the movement of the construction machine caused by the action on the operating lever is unintentional and must be prevented.

According to a further optional modification of the present disclosure, it can be provided that the device also comprises a seatbelt buckle switch for detecting whether a seatbelt of the seat of the construction machine is secured with a seatbelt buckle, wherein the evaluation unit is designed to limit or stop a capacity of the construction machine also depending on the detected state of the seatbelt buckle switch.

A seatbelt buckle switch is now provided as a further sensor that the evaluation unit takes into consideration for detecting the different states.

Furthermore, the device can comprise a selector switch for detecting one of a plurality of possible operating modes of the construction machine, wherein the evaluation unit is designed to limit or stop a capacity of the construction machine also as a function of the detected state of the selector switch, and the operating modes of the construction machine comprise a working mode, a parking mode and a road driving mode.

"Road mode", "parking mode" and "working mode" relate to different settings or configurations of the machine, which are optimised for specific operating states or applications.

Road mode of an excavator is generally used if the machine is being driven over roads or construction sites. In this mode, the machine is set so that it can be moved easily and safely, often with a speed limit to ensure safety. In addition, certain functions such as the swivelling function of the upper carriage or the movement of the boom on an excavator may be deactivated in this mode in order to increase stability while driving.

If the excavator is parked or not used for a longer period of time, it is put into parking mode. In this state, all operating systems are usually shut down and the machine is secured to prevent unintentional start-up or movement. This can comprise inserting safety locks, lowering the working tools to the ground and activating anti-theft systems.

Working mode is the configuration used for normal operation of the excavator or construction machine during construction work. In this mode, all functions of the machine are activated to maximise efficiency and performance. Using an excavator as an example, this includes the full functionality of the boom, bucket and other implements.

Furthermore, according to a particular embodiment of the present disclosure, it can be provided that the evaluation unit is designed to limit or stop a capacity of the construction machine if the selector switch detects that the construction machine is in road driving mode and if the seatbelt buckle switch detects that the seatbelt of the seat of the construction machine is not secured with the seatbelt buckle, optionally wherein the evaluation unit is designed to reduce the maximum driving speed of the construction machine in such a case, optionally to zero.

According to the disclosure, it can also be provided that the device comprises an emergency stop switch for immediately deactivating the servo circuit of the construction machine.

The emergency stop switch is typically actuated manually by the operator of the construction machine if they have recognised a dangerous state. Actuating the emergency stop switch causes the construction machine to stop moving immediately so that there is no further danger from the construction machine.

According to an embodiment of the present disclosure, it can be provided that the evaluation unit is implemented by a logic gate, wherein for example the logic gate only uses the logical operations AND, OR, NOT, NAND, NOR, XOR and XNOR to monitor the different states.

The logical interconnection of the various sensors using a logic gate creates a robust and very easy-to-implement device for monitoring and assisting a construction machine operator.

According to another further development of the present disclosure, it can be provided that the evaluation unit is designed to enable safety-relevant operation of the construction machine only when the grip switch detects that at least one of the two operating levers is actuated by the operator, and if the seat contact switch detects that the operator is sitting in the seat of the construction machine, and/or the evaluation unit is designed to enable safety-relevant operation of the construction machine only when the grip switch detects that both operating levers have been actuated by the operator.

This means that safety-relevant operation of the construction machine can only be enabled when the evaluation unit detects that the operator of the construction machine has actually sat down in the seat and actuated one or both control levers. A certain action of the construction machine, for example, can be regarded as a safety-relevant operation if there is an increased risk potential.

According to the disclosure, it can also be provided that the construction machine is an excavator, for example a hydraulic excavator, and the servo circuit is used to implement the movements and operations of the excavator, for example the rotation of the upper carriage and the movement of the excavator arm.

The disclosure also relates to a construction machine, for example a hydraulic excavator, having a device according to any one of the preceding aspects, optionally wherein the device replaces the safety lever normally provided on the construction machine.

If the device according to the disclosure is implemented in a construction machine, the functionality previously assumed by the safety lever can be assumed by the device according to the disclosure. This makes it possible to dispense with the safety lever, which is often perceived by some operators as a nuisance and is sometimes intentionally moved incorrectly in order to enable the working machine to be operated in a state that is actually prohibited, which is advantageous from the operator's point of view. In order to avoid this obvious bypassing of such an actuation of the working machine, the functionalities of the safety lever can be transferred to the device according to the disclosure. This is much more difficult to circumvent than the safety lever, which only needs to be deliberately moved to its release position, thus increasing the overall safety of the construction machine. Incorrect use of the safety lever is often due to untrained personnel who have not been trained in the correct use of the safety lever.

BRIEF DESCRIPTION OF THE FIGURES

Further features, details and advantages of the disclosure can be seen in the following description of the figures. In the figures.

DETAILED DESCRIPTION

Figure 1A:
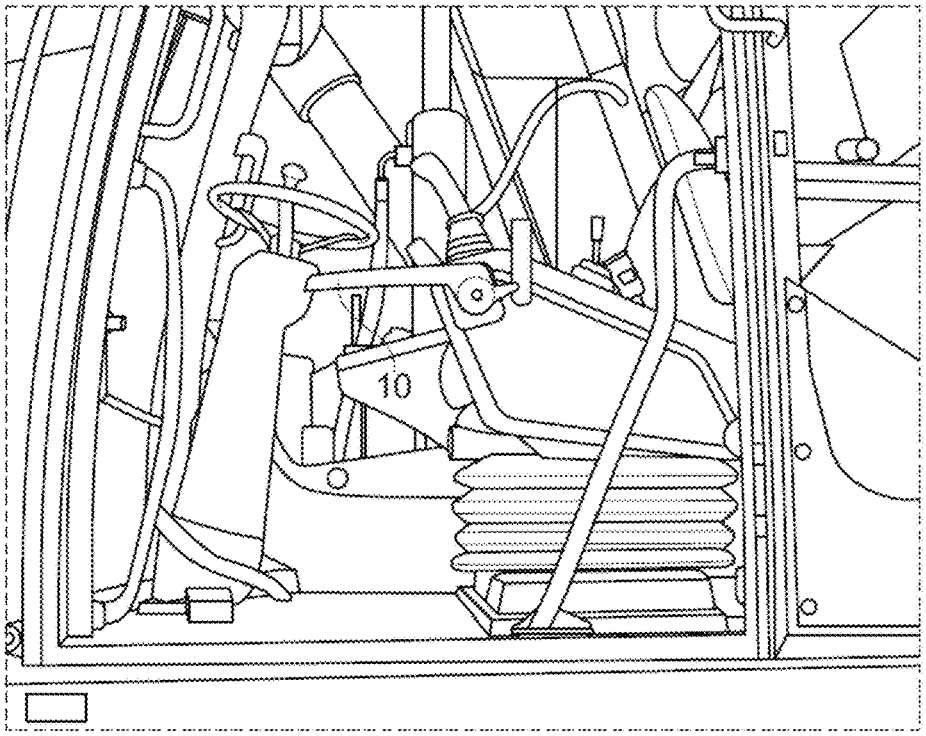
Fig. 1A Prior art
FIG. 1A: shows a side view of a driver's cab according to the prior art with a safety lever in blocking position.

FIG. 1A shows a side view into a driver's cab of a construction machine according to the prior art. In the representation it can be seen that the safety lever 10 has been brought into a horizontal position, which prevents access to the driver' seat in the form of a barrier. If an operator wishes to get into the seat, they must first move the safety lever 10 to a vertical position, wherein the safety lever must be folded down in the embodiment shown.

Figure 1B:
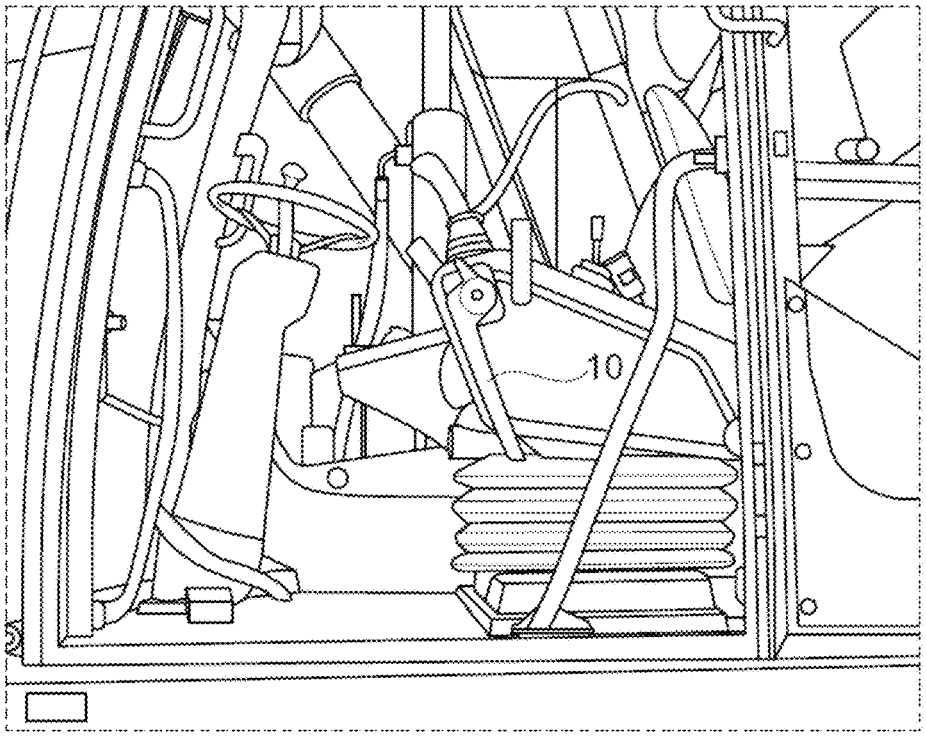
Fig. 1B Prior art
FIG. 1B: shows a side view of a driver's cab according to the prior art with a folded-down safety lever.

FIG. 1B shows a view of the driver's cab in which the safety lever 10 is folded down vertically. The operator now has free access to the seat, or an operator sitting in the seat can now leave the driver's cab.

The safety lever ensures that the servo circuit for actuating the construction machine is interrupted when the machine is folded up or down from the horizontal position, so that the construction machine cannot be actuated unintentionally when the operator leaves the driver's cab. This contributes to the improved safety of the construction machine, but can easily be bypassed in the event of deliberate operating errors.

Figure 2:
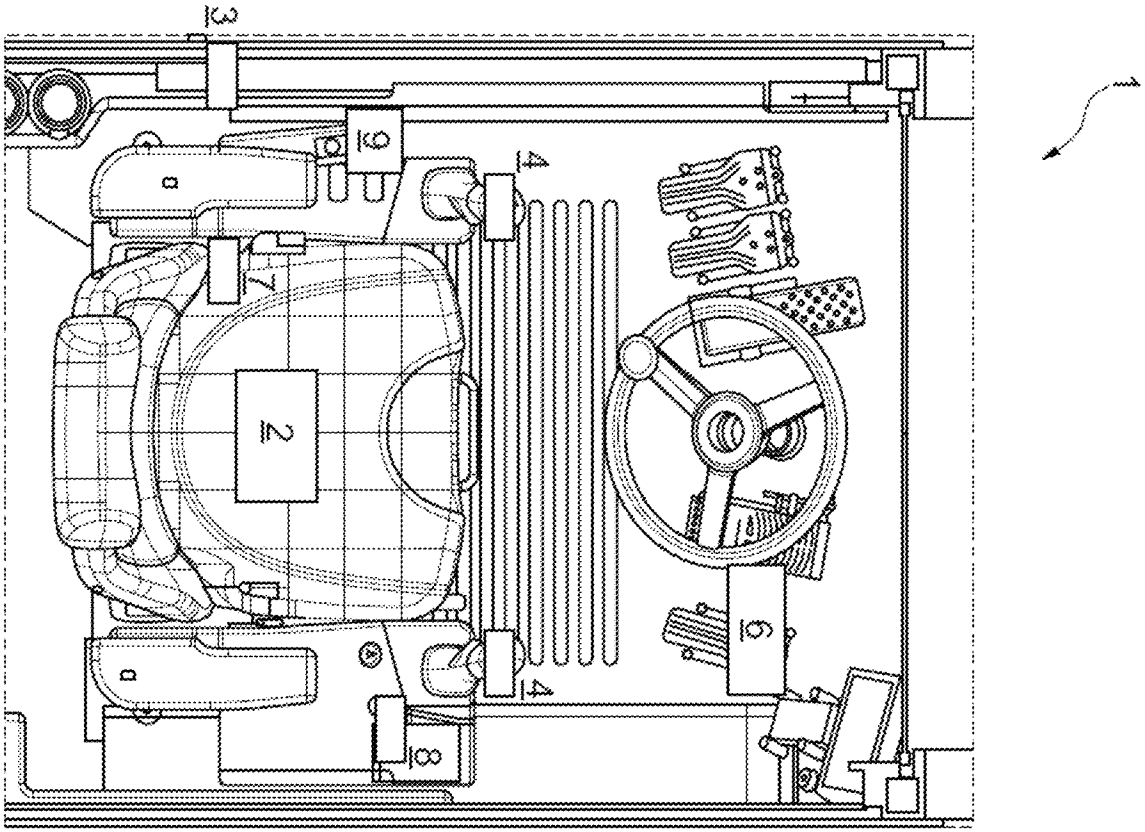
FIG. 2: shows a schematic top view of a driver's cab to illustrate the device according to the disclosure.

FIG. 2 shows the sensors required by the device 1 according to the disclosure in a top view of the driver's cab.

A seat contact switch 2, a door close switch 3, a grip sensor 4, a driving function switch 6, a seatbelt buckle switch 7, a selector switch 8 and an emergency stop switch 9 can be seen.

Each of the above-mentioned sensors is connected to an evaluation unit (not shown in FIG. 2, but see reference numeral 5 in FIGS. 3-10), which assumes different case configurations for the construction machine depending on the states of the plurality of sensors and, depending on this, limits or prevents the capacities of the construction machine.

Figure 3:
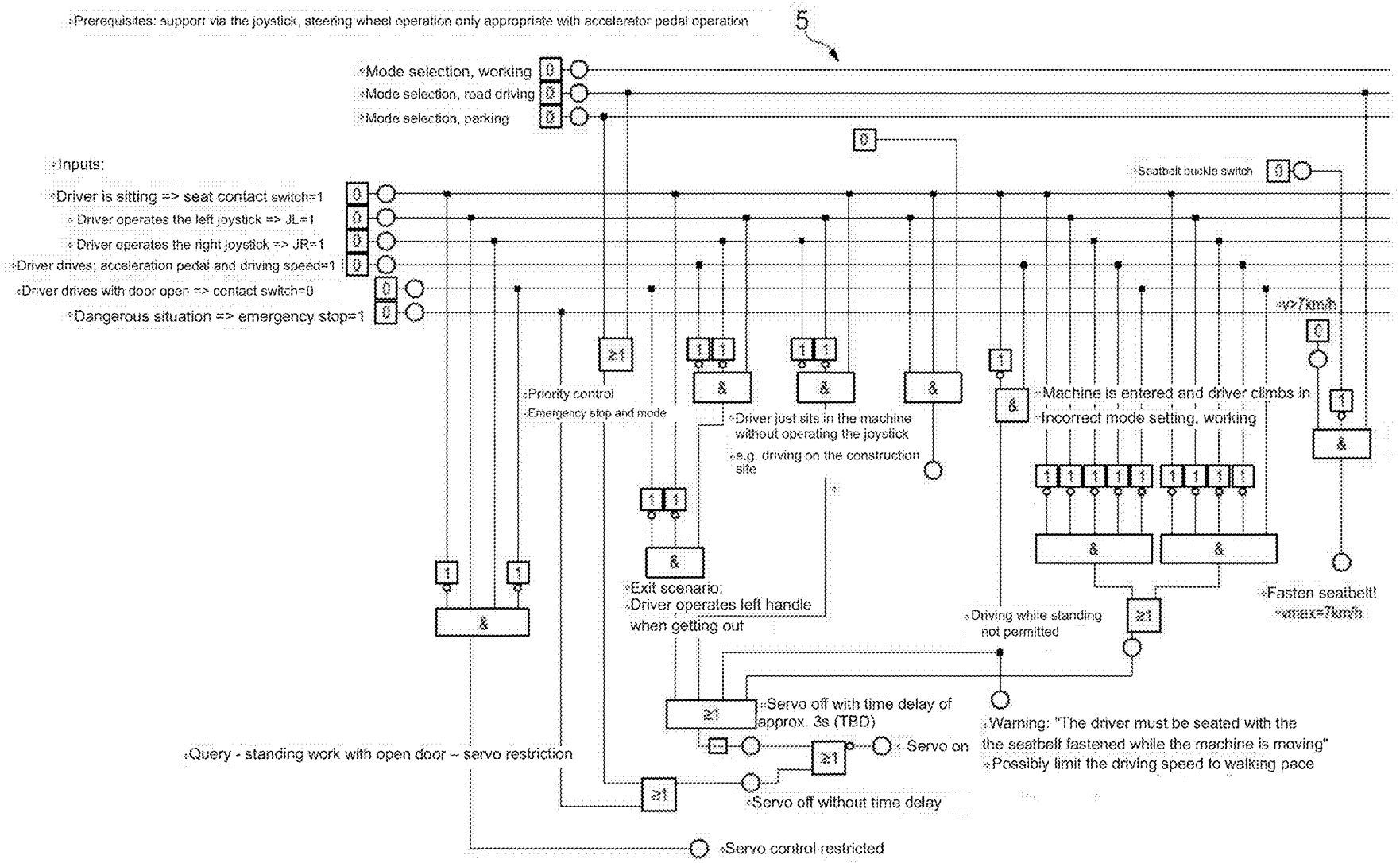
FIG. 3: shows a representation of the evaluation unit using a logic gate.

FIG. 3 shows an implementation of the evaluation unit 5 using a logic gate, wherein the different sensors send binary signals for the presence or absence of the respective state to be detected to the evaluation unit 5 via a signal line. It may be provided that the signal is transmitted to the evaluation unit 5 in binary form by means of a voltage level, e.g. +or −5V.

It can also be seen that the selector switch 8 can apply a logical 1 to a signal line for each of the different operating modes of the construction machine. If, for example, the selector switch is switched to operating mode, the corresponding line is energised with a logical 1. If, on the other hand, the selector switch is set to road driving mode, a logical 1 is applied to the associated signal line. The same applies for the parking mode.

The situation is very similar with the other sensors, where the presence of a detected state also leads to a defined signal state of an associated signal line.

Figure 4:
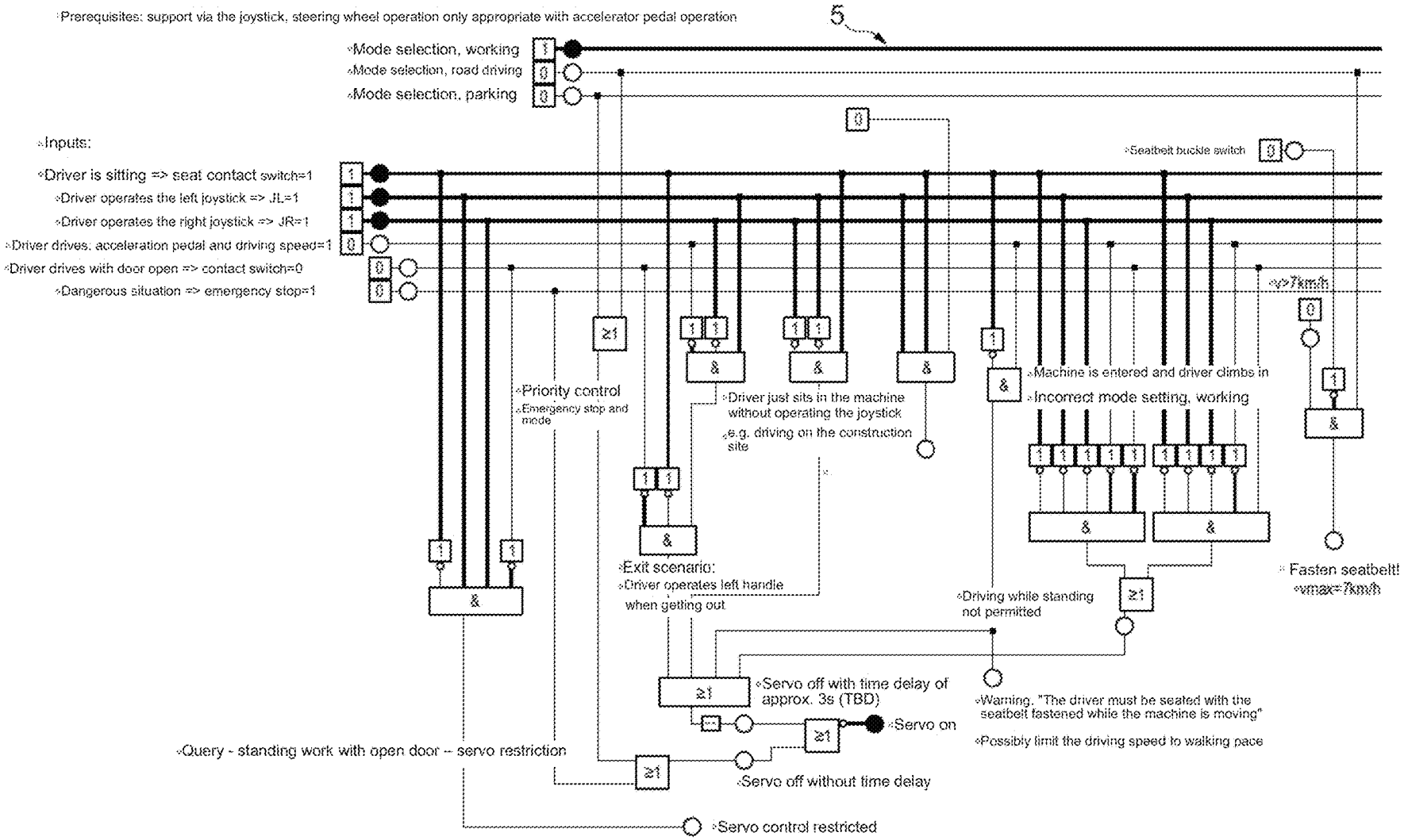
FIGS. 4-10: show different circuitry of the evaluation unit for exemplary representation of the states that can be detected with the evaluation unit.

FIG. 4 now shows an application in which the selector switch 8 is switched to operating mode and the corresponding line is energised with a logical 1.

In addition, the driver works with the door open, as can be seen from the associated switching status of the door close switch. An open door is mapped with a logical 0. It can also be seen that the driver is sitting in their seat and operating both the left and right control levers. Since working with the door open is not categorised as a dangerous state, the logic gate causes the servo circuit to operate normally.

Figure 5:
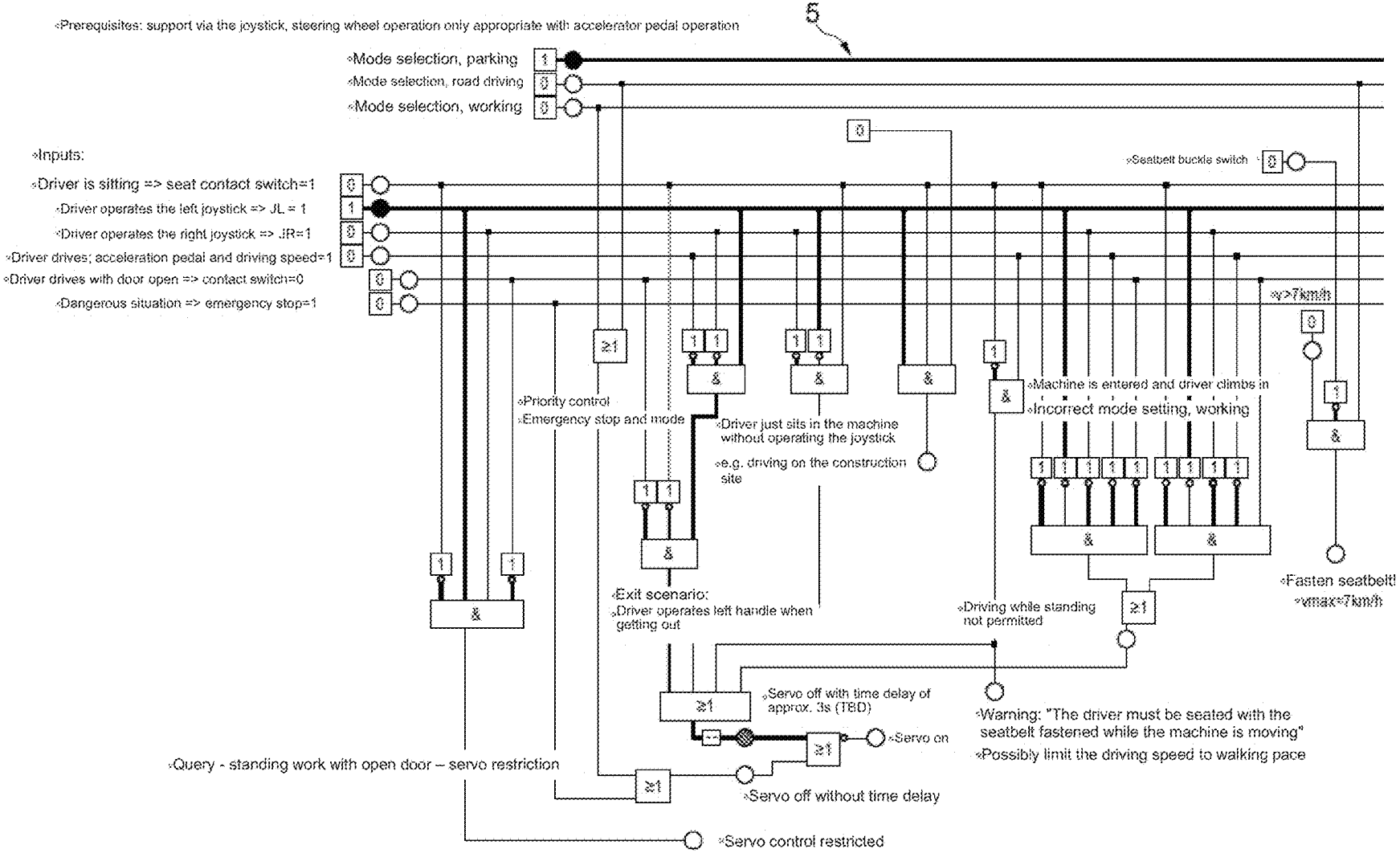

FIG. 5 shows an application in which the operator of the construction machine unintentionally touches the left handle when getting out of the machine in working mode, which would cause the construction machine, for example the excavator, to move. However, since a logical interconnection for detecting an open seat contact switch, an actuated left control lever, an open door and an unactuated driving function switch, for example an accelerator pedal switch, and an unactuated right handle is queried by inverter modules and AND modules, a state can be recognised that indicates that the operator has inadvertently actuated a left control lever when exiting the vehicle. In such a case, the servo circuit is stopped immediately or with a short time delay to prevent unintentional movement of the construction machine.

Figure 6:
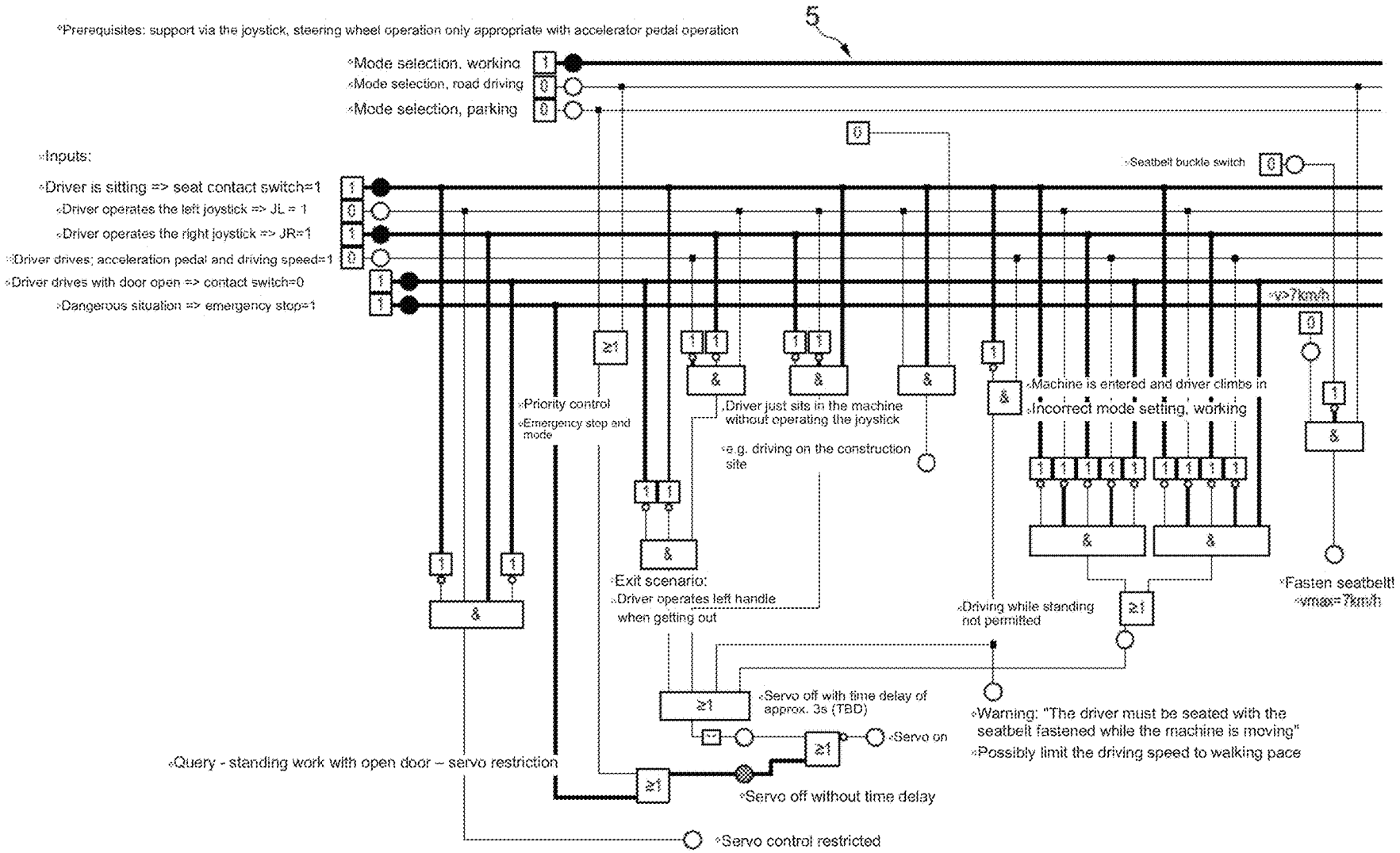

FIG. 6 shows an application in which the operator of the construction machine actuates the emergency stop switch. This directly leads to the servo circuit stopping so that there is no further danger from the construction machine. The states of the other sensors are irrelevant, as the emergency stop switch always leads to an immediate stop.

Figure 7:
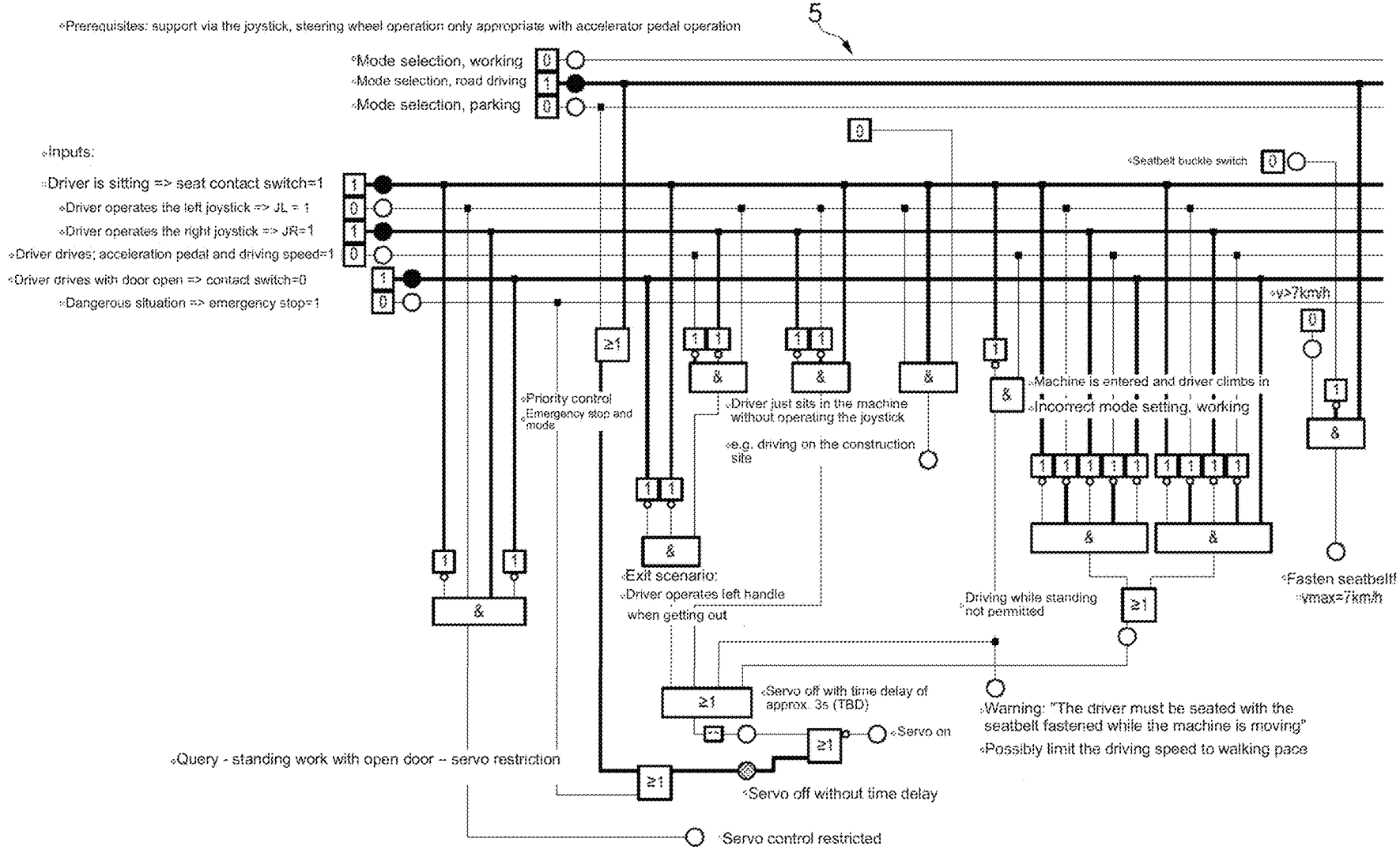

FIG. 7 shows the state in which the selector switch is switched to road driving mode, but an operating lever is still controlled to operate the primary functions of the construction machine. However, as the excavator, for example, does not have to perform its excavator function in road driving mode, this means that the servo circuit is stopped immediately when road driving mode is selected. The same applies when parking mode is selected, as the servo circuit is also stopped immediately in this case.

Figure 8:
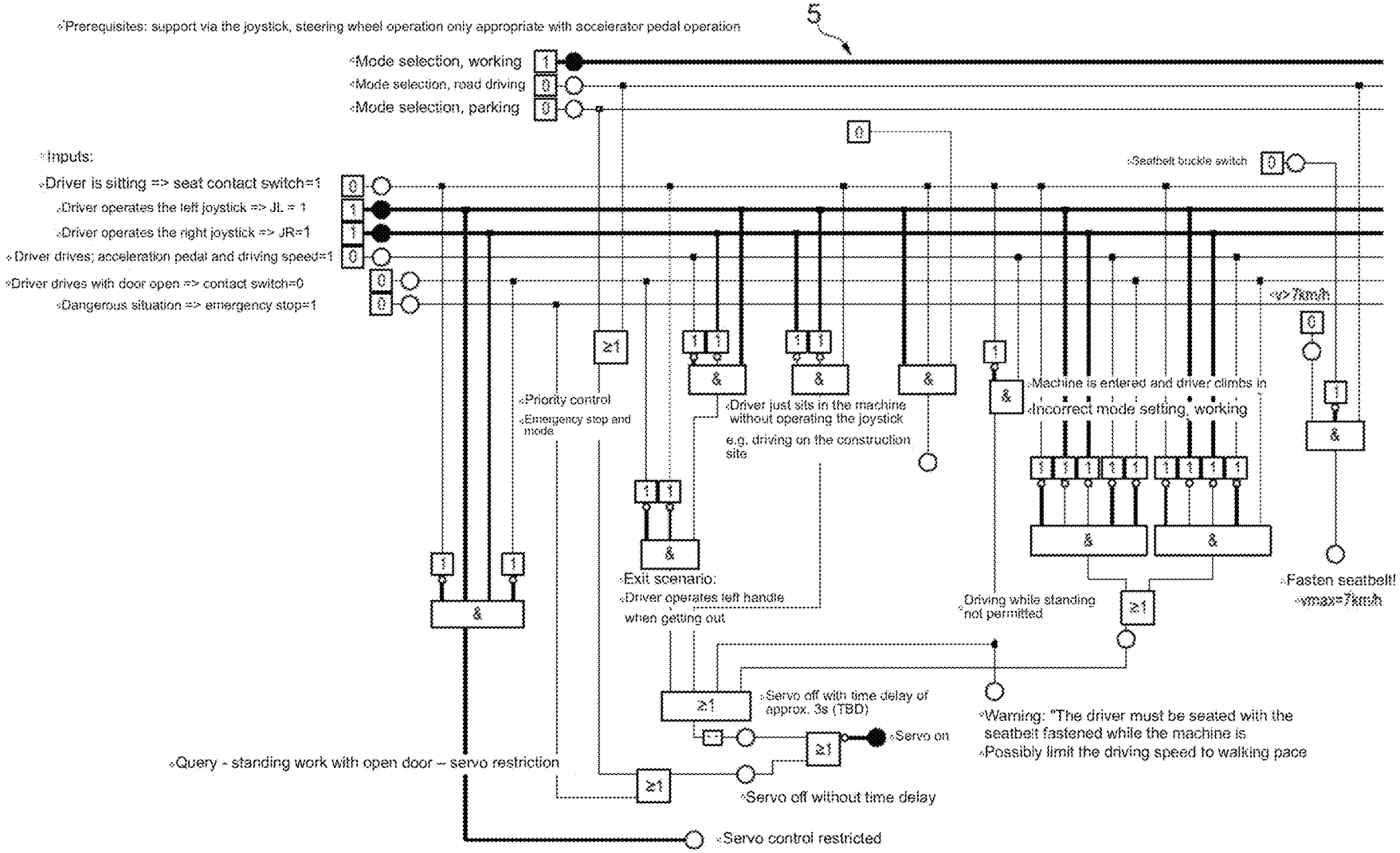

FIG. 8 shows an application in which the operator operates the construction machine while standing and the door is open at the same time. Operation of the construction machine is determined by actuating both the left and right control levers. If it is also detected that the door is open and the seat contact switch is not closed (i.e. the operator of the construction machine is not sitting in the seat), the logic in the evaluation unit means that servo control is only possible to a limited extent. This can be achieved by reducing the upper carriage speed of the construction machine or by reducing the maximum operating speed of the attachments of the construction machine. Using the example of an excavator, for example, it can be provided that the excavator boom can only be moved at a slower speed if the state shown in FIG. 8 has been recognised.

This is implemented in the evaluation unit by connecting an AND element to the signals of the sensors to be checked. In this case, these are the signals from the seat contact switch, the two operating levers and the door close switch. Assuming that the seat contact switch outputs a logical 1 when an operator has taken a seat on the operating seat, the door lock switch outputs a logical 1 when the door is closed and a logical 1 is output when a respective operating lever is actuated, the two signal lines of the seat contact switch and the door close switch must be inverted before being entered into the AND element. If the AND element then outputs a logical 1, this results in the servo circuit being restricted in order to achieve the restrictions described above, for example.

Figure 9:
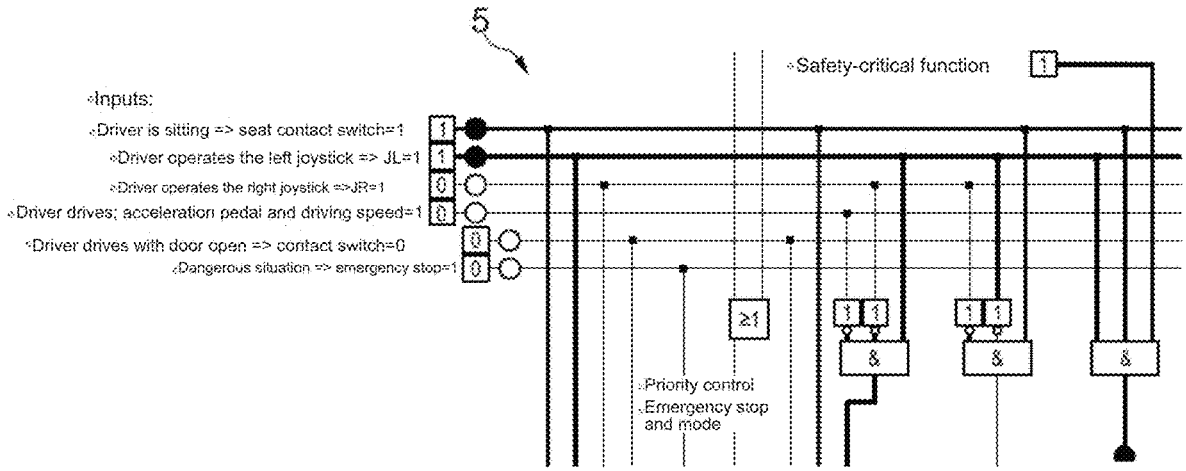

FIG. 9 shows another possibility in which the device according to the disclosure also has a further sensor that checks whether a safety-critical function of the construction machine is actuated. A safety-critical function of the construction machine can be a function of the construction machine that has a particular danger potential. Using the example of an excavator, such a function can be, for example, the deflection of the excavator arm beyond a certain angle range or similar.

In such a case, due to the desired safety-critical function, the device may require the operator to sit in the seat and have both hands on the respective control levers. This reduces the likelihood of an accident, as the operator has been forced to sit in the seat and have both hands on the control levers, at least to perform the safety-critical function. However, it is still possible to perform other, non-safety-critical functions while standing in order to give the operator as much room for manoeuvre as possible, making it easier for them to work with the construction machine on a daily basis.

For this purpose, the evaluation unit can be provided with a further signal line to which a logical 1 is sent if the operation of a safety-critical function is required. Together with the two signals from the operating levers, the three signals are then interconnected with an AND element so that a logical 1 is only output if all three signals have a logical 1. Only then will the safety-critical function be enabled.

The definition of what exactly constitutes a safety-critical function of a construction machine is subject to a variety of aspects and can also affect the general operation of the excavator boom. In such a case, two-handed operation is therefore required, as operation with only one hand would lead to the excavator boom not being actuated.

Figure 10:
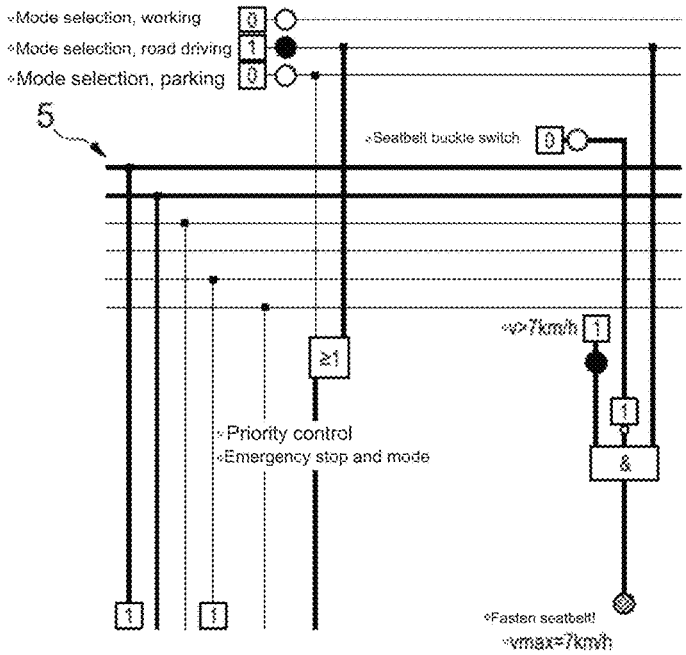

FIG. 10 shows an application in which the driving speed of the construction machine is reduced to a speed greater than zero if the operator has not fastened their seatbelt. For this purpose, the signal of the seatbelt buckle switch is analysed together with the signal of a signal set to road driving via the selector switch. If the selector switch therefore provides the signal for road driving and the seatbelt buckle switch indicates that the seatbelt is not fastened, the speed may be limited to a value that is below the maximum speed of the construction machine (but above 0 km/h).

For this purpose, a further signal is sent to the evaluation unit if the speed is above a predetermined threshold value. For example, this can be when the speed exceeds 7 km/h, so that a signal with a logical 1 is then sent to the evaluation unit. These three signals are connected to an AND element so that the AND element outputs a logical 1 if the seatbelt is not fastened, the construction machine is in road driving mode and the driving speed is more than the predetermined threshold value (e.g. 7 km/h).

This signal output by the AND element then causes the maximum driving speed of the construction machine to be reduced, e.g. to the predetermined threshold value.

In other words, it is checked whether the operator of the construction machine is wearing their seatbelt. If they are not, the construction machine can only be driven at a reduced speed.

According to the disclosure, a device for monitoring and assisting an operator of a construction machine is thus created, which can also be used, among other things, to replace the safety lever of a construction machine, for example an excavator, by evaluating various sensors.

LIST OF REFERENCE NUMERALS

1 Device for monitoring and assisting
2 Seat contact switch
3 Door close switch
4 Grip sensor
5 Evaluation unit
6 Driving function switch
7 Seatbelt buckle switch
8 Selector switch
9 Emergency stop switch
10 Safety lever

The invention claimed is:

1. A device for monitoring and assisting an operator of a construction machine, comprising:

a seat contact switch for detecting whether the operator is sitting in a seat of the construction machine;

a door close switch for detecting whether a door of a driver's cab of the construction machine is closed;

a grip sensor for detecting whether an operating lever arranged to the left of the seat and/or an operating lever arranged to the right of the seat for controlling a servo circuit of the construction machine is actuated by the operator;

a driving function switch for detecting whether a driving function or an accelerator pedal of the construction machine is actuated; and an evaluation unit designed to limit or stop a capacity of the construction machine depending on detected states of the seat contact switch, the door close switch, the grip sensor, and a detected state of the driving function switch and to output a signal for signaling a critical state, wherein the evaluation unit is designed to limit a maximum driving speed of the construction machine if the seat contact switch detects that the operator is not sitting in the seat of the construction machine, and if the driving function switch detects that a joystick or an acceleration pedal of the construction machine controlling the driving function is actuated, and wherein the evaluation unit is designed to initially limit the maximum driving speed of the construction machine for a certain period of time and then set the maximum driving speed to zero.

2. The device according to claim 1, wherein the capacity of the construction machine comprises a driving speed of the construction machine, an upper carriage speed of the construction machine and/or operating the servo circuit of the construction machine.

3. The device according to claim 1, wherein the evaluation unit is designed to limit or stop the capacity of the construction machine if the seat contact switch detects that the operator is not sitting in the seat of the construction machine, if the door close switch detects that the door of the driver's cab is open, and if the grip sensor detects that one or both of the operating levers are actuated.

4. The device according to claim 3, wherein the evaluation unit is designed to limit a maximum upper carriage speed of the construction machine.

5. The device according to claim 1, wherein the evaluation unit is designed to stop the servo circuit of the construction machine if the seat contact switch detects that the operator is sitting in the seat of the construction machine and if the grip sensor detects that neither of the operating levers for actuating the servo circuit of the construction machine are actuated.

6. The device according to claim 5, wherein the evaluation unit is designed to stop the servo circuit of the construction machine only after a certain period of time has elapsed in the state leading to the stop.

7. The device according to claim 1, wherein the evaluation unit is designed to limit or stop the capacity of the construction machine if the seat contact switch detects that the operator is not sitting in the seat of the construction machine, if the grip sensor detects that only the left of the two operating levers is actuated, and if the driving function switch detects that an acceleration pedal or a joystick are not actuated.

8. The device according to claim 7, wherein the evaluation unit is designed to limit or stop the servo circuit in response to the seat contact switch detecting that the operator is not sitting in the seat of the construction machine, the grip sensor detecting that only the left of the two operating levers is actuated, and the driving function switch detecting that the acceleration pedal or the joystick are not actuated.

9. The device according to claim 1, further comprising a seatbelt buckle switch for detecting whether a seatbelt of the seat of the construction machine is secured with a seatbelt buckle, wherein the evaluation unit is designed to limit or stop the capacity of the construction machine also depending on a detected state of the seatbelt buckle switch.

10. The device according to claim 1, further comprising a selector switch for detecting one of a plurality of possible operating modes of the construction machine, wherein the evaluation unit is designed to limit or stop the capacity of the construction machine also as a function of a detected state of the selector switch, and wherein the plurality of possible operating modes of the construction machine comprise a working mode, a parking mode and a road driving mode.

11. The device according to claim 10, wherein the evaluation unit is designed to limit or stop the capacity of the construction machine if the selector switch detects that the construction machine is in road driving mode and if a seatbelt buckle switch detects that a seatbelt of the seat of the construction machine is not secured with a seatbelt buckle.

12. The device according to claim 11, wherein the evaluation unit is designed to reduce a maximum driving speed of the construction machine in response to the selector switch detecting that the construction machine is in road driving mode and the seatbelt buckle switch detecting that the seatbelt of the seat of the construction machine is not secured with the seatbelt buckle.

13. The device according to claim 1, further comprising an emergency stop switch for immediately deactivating the servo circuit of the construction machine.

14. The device according to claim 1, wherein the evaluation unit is implemented by a logic gate, wherein the logic gate only uses the logical operations AND, OR, NOT, NAND, NOR, XOR and XNOR to monitor the different states.

15. The device according to claim 1, wherein the evaluation unit is designed to enable safety-relevant operation of the construction machine only when the grip sensor detects that at least one of the two operating levers is actuated by the operator, and if the seat contact switch detects that the operator is sitting in the seat of the construction machine, and/or the evaluation unit is designed to enable safety-relevant operation of the construction machine only when the grip sensor detects that both operating levers have been actuated by the operator.

16. The device according to claim 1, wherein the construction machine is a hydraulic excavator, and the servo circuit is used to implement movements and operations of the hydraulic excavator.

17. A construction machine having the device according to claim 1, wherein the construction machine does not comprise a safety lever.

* * * * *